United States Patent [19]

Willitts

[11] 4,231,229

[45] Nov. 4, 1980

[54] ENERGY CONSERVATION SYSTEM HAVING IMPROVED MEANS FOR CONTROLLING RECEIVER PRESSURE

[75] Inventor: Benjamin R. Willitts, Lawrenceville, N.J.

[73] Assignee: Emhart Industries, Inc., Farmington, Conn.

[21] Appl. No.: 22,583

[22] Filed: Mar. 21, 1979

[51] Int. Cl.[3] ..... F25B 41/00

[52] U.S. Cl. ..... 62/196 A; 62/509

[58] Field of Search ..... 62/196 R, 196 A, 196 B, 62/509

[56] References Cited

U.S. PATENT DOCUMENTS

| | | | |
|---|---|---|---|
| Re. 27,522 | 11/1972 | Schenck et al. | 62/196 |
| 2,954,681 | 10/1960 | McCormack | 62/196 |
| 2,963,877 | 12/1960 | Malkoff et al. | 62/196 |
| 3,088,292 | 5/1963 | Kocher | 62/196 |
| 3,126,715 | 3/1964 | Kocher | 62/151 |
| 3,145,543 | 8/1964 | Miner | 62/149 |
| 3,274,793 | 9/1966 | Anderson et al. | 62/151 |
| 3,324,673 | 6/1967 | Lindahl et al. | 62/196 |
| 3,389,576 | 6/1968 | Maurer | 62/196 |
| 3,427,819 | 2/1969 | Seghetti | 62/196 |
| 3,905,202 | 9/1975 | Taft et al. | 62/152 |
| 4,012,921 | 3/1977 | Willitts et al. | 62/509 |
| 4,136,528 | 1/1979 | Vogel et al. | 62/174 |

OTHER PUBLICATIONS

Catalog C-806A, Jan. 1978, Sec. #5 Kramer Trenton Co., Trenton, N.J., *Thermobank-2.*

Air Conditioning, Heating & Refrigerating News, 1/24/77, *New McQuay Ref. Unit Said to Eliminate Flash Gas,* p. 5.

McQuay Cat. No. 649, Copr. 1977, pp. 5-7, 35, 39, 40.

*Supplement 3,* pp. 1-4, McQuay-Perfex Inc., Minn., Minn., 1978.

Seasonmiser Supplement, Control Circuit, pp. 1-4, Form 347653A, McQuay-Perfex Inc., 1978.

*Primary Examiner*—Ronald C. Capossela

*Attorney, Agent, or Firm*—Frederick A. Zoda; John J. Kane; Albert Sperry

[57] ABSTRACT

Disclosed is a means for preventing "logging" of receivers, that is, the excess filling of a receiver with liquid in a refrigeration system of the type in which a compressor, a condenser, and one or more evaporators are connected in a closed cycle in association with a surge receiver. Communication between the discharge side of the compressor and the receiver incorporates a valve of the differential pressure regulating type, having means sensitive to the relationship of pressures established and maintained in a liquid line extending from the condenser to the evaporator and in the compressor discharge line extending from the compressor to the condenser, respectively. The valve responds to the pressure differential between these lines to maintain pressure in the receiver at a value slightly less than the maintained condensing pressure existing in the liquid line, to prevent excess liquid from accumulating in the receiver and in this way eliminate "starving" of the expansion valves associated with the evaporators. The disclosed means for establishing and maintaining receiver pressure in a preferred embodiment utilizes a capillary sensing element in association with the differential pressure regulating valve. The element senses pressure in the liquid line upstream from an inlet pressure regulating valve. The inlet pressure regulating valve establishes and maintains an optimum condensing pressure and as a consequence thereof establishes the desired optimum differential between the pressures at the inlet and outlet sides of the condenser.

8 Claims, 1 Drawing Figure

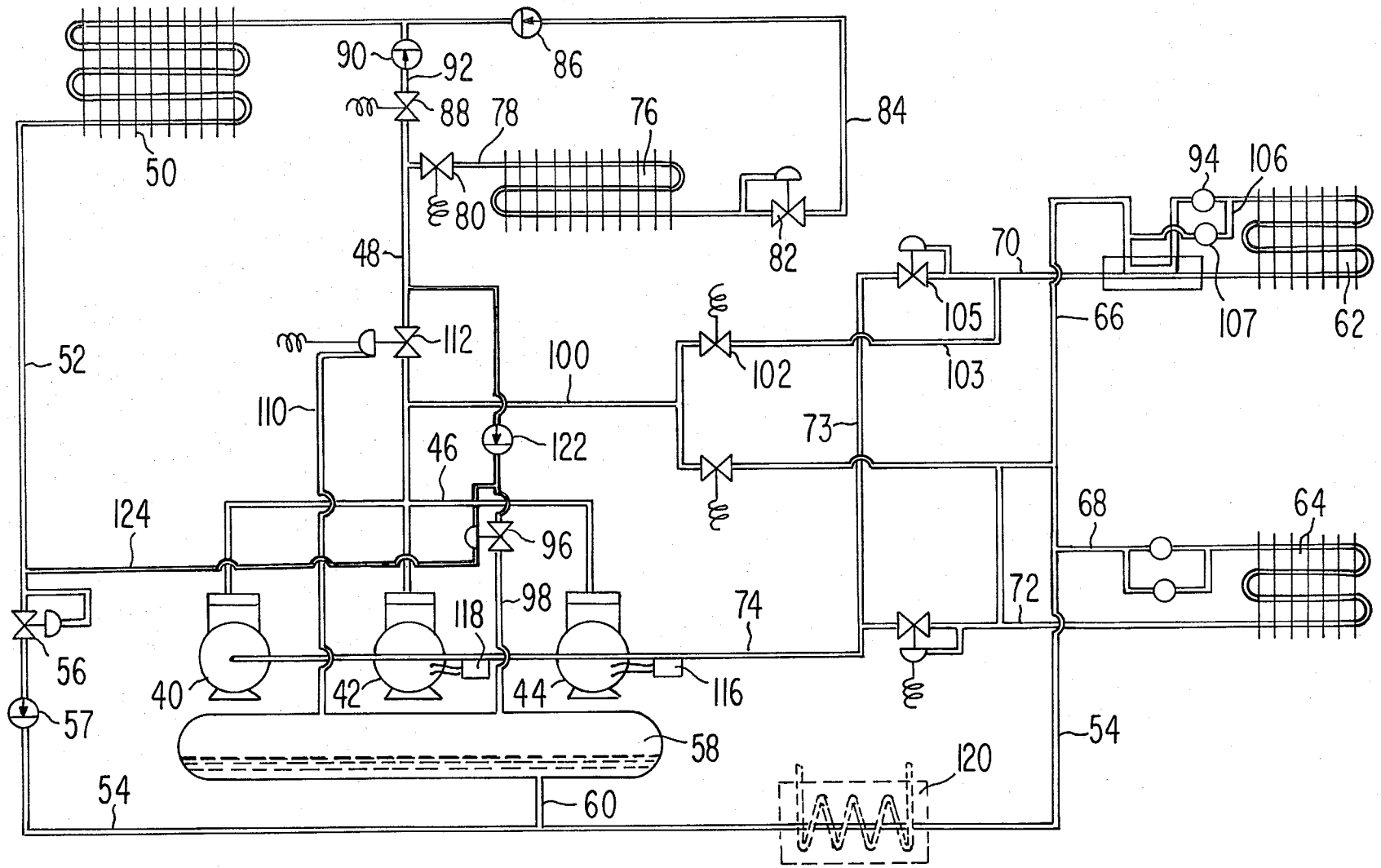
62
64
106
107
94
66
68
54
70
72
105
103
120
84
82
73
102
74
116
58
76
86
100
122
96
98
44
60
78
80
92
88
112
46
118
90
48
42
110
40
50
124
52
56
57
54

ENERGY CONSERVATION SYSTEM HAVING IMPROVED MEANS FOR CONTROLLING RECEIVER PRESSURE

BACKGROUND OF THE INVENTION

1. Field Of The Invention

The present invention relates to those refrigeration systems that are especially suitable for use in refrigerating food products displayed in refrigerated display cases, especially though not necessarily those of the open front type, installed in food supermarkets. In a more particular sense the invention may be classified as an improvement in refrigeration systems of the type that utilize the concept of effecting power savings through sub-cooling of a refrigerant within a condenser exposed to outside ambient air temperatures. In systems of this type, natural sub-cooling is controlled in a manner to reduce compressor operation with resultant power savings. This is done by varying the effective capacity of the condenser through controlled flooding thereof.

In yet a more particular sense the improvement comprising the present invention can be appropriately classified as an automatic control in refrigeration systems of the category described in which pressures within a surge receiver are automatically regulated to closely follow an automatic condensing and compressor discharge pressure regulating function.

2. Description Of The Prior Art

A refrigeration system in which the present improvement is especially suited for use is exemplified by U.S. Pat. Nos.3,905,202 to Taft et al; and 4,012,921 to Willitts et al.

A system of the type disclosed by these patents works admirably, in effecting power savings under a wide variety of differing outside ambient air temperatures. However, under certain circumstances it becomes desirable to incorporate additional, improved features in such systems, as regards establishing and maintaining pressures in the surge receiver characteristically employed in such a system.

At present, there is provided, in the patented systems referred to, means in the form of an outlet pressure regulating valve, connected between the compressor discharge and the receiver. This valve has been sensitive to existing receiver pressures. The valve has a fixed setting, and whenever the receiver pressure drops below this setting, the valve opens to communicate the compressor discharge with the receiver, to raise the receiver pressure to the fixed setting.

Keeping in mind that the receiver pressure must at all times be lower than the head pressure of the system (that is to say, the pressure in the discharge line extending from the compressor to the condenser), a problem has been produced in that one cannot operate the system at head pressures lower than the fixed receiver pressure control valve setting. This has reduced the versatility of the system and the capability thereof as regards saving energy.

A problem of at least equal or perhaps even greater significance, in the prior art, results from the fact that utilizing a fixed setting in the receiver pressure control valve arrangement, sensitive only to existing receiver pressure, has produced "logging" of liquid within the receiver, under certain circumstances. This is a condition in which the receiver tends to fill with an excessive amount of liquid, and as a consequence tends to deprive or "starve" the expansion valves associated with the several evaporators. Starving of the expansion valves means that the valves are not supplied with sufficient liquid condensate to efficiently discharge their function.

For the reasons given above, the prior art devices have failed to operate with as much efficiency, in all types of outside ambient air temperature conditions, as would be desirable. This undesirable condition, it is believed, derives from an inherent lack of flexibility in the means for controlling receiver pressures. This lack of flexibility in respect to the control of receiver pressures has in turn produced a corresponding, undesirable limitation of the range of condensing and head pressures considered desirable to make optimum usage of the widely varying ambient temperatures found in the various seasons of the year. Thus, while atmospherically responsive refrigerating systems of the type disclosed in the above-mentioned patents represent an important advance in the art, it has been found desirable to increase the general capability thereof for making the most efficient use possible of varying climatic conditions.

SUMMARY OF THE INVENTION

In accordance with the present invention, a refrigeration system of the type shown, for example, in U.S. Pat. No. 3,905,202 utilizes a pressure differential control valve in place of the outlet pressure regulating valve presently incorporated in a line connected between the compressor discharge line and the receiver. The valve installed pursuant to the present invention is sensitive to pressures developed within the liquid line extending from the condenser, upstream from a modulating pressure responsive valve now installed in the liquid line as an automatic control of condensing and head pressures. The mentioned modulating pressure responsive valve is in and of itself part of the systems disclosed in the named patents, and is effective to establish and maintain, automatically, pressures in the liquid line from the condenser and in the compressor discharge line at preselected operating levels with a continuously existing pressure differential therebetween. In accordance with the invention, it is proposed to control receiver pressure by causing the receiver pressure to be established and maintained at all times at values that are a function of the condensing and head pressures, and the differential therebetween, effected by the modulating pressure responsive valve means.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

The FIGURE is a schematic representation of a refrigeration system embodying the present improvement.

DETAILED DESCRIPTION OF THE PREFERRED EMBODIMENT

In the single FIGURE of the drawing, there is illustrated a refrigeration system which is like that disclosed both in U.S. Pat. No. 3,905,202 issued to Taft et al and U.S. Pat. No. 4,012,921 issued to Willitts et al, so far as the basic essentials of such a system are concerned. Accordingly, the present invention has been illustrated as applied to a system like that in FIG. 2 of U.S. Pat. No. 3,905,202, in which by way of example three compressors 40, 42, 44 are connected in parallel with a common gas discharge manifold 46 from which compressed gaseous refrigerant is forced under pressure through a compressor discharge line 48 to condenser 50 positioned to be cooled by ambient air and having a capacity sufficient to condense the entire refrigerant discharged from all three compressors. Condensed liquid refrigerant is forced under pressure from condenser 50 through a liquid line 52 extended at 54 through a modulating pressure responsive valve 56. Not illustrated in the mentioned U.S. patents, but found desirable in practice, is a check valve 57 mounted in liquid line 54 downstream from valve 56.

A surge receiver 58 is connected at its bottom to a connecting line 60 extending downwardly to a juncture with liquid line 54. Line 54 continues past receiver 58, and is connected to evaporators 62, 64 through lines 66, 68 respectively. Refrigerant from the evaporators is returned to the compressors through return lines 70, 72, connected to a return manifold 73 extending into communication with the common return header 74 of the several compressors. Not essential to the present invention, but desirable in a typical commercial installation, is a heat reclaim means illustrated herein and in U.S. Pat. No. 3,905,202 as including a heat reclaim coil 76, connected to discharge line 48 through a bypass line 78 and a thermostatically controlled solenoid valve 80. A condenser inlet pressure regulating valve 82 is connected in a line 84 extending from coil 76 to the condenser 50 through a check valve 86, and serves to maintain the desired head pressure in the compressor when the heat reclaim coil 76 is in use. A solenoid valve 88 and check valve 90 are located in section 92 of the compressor discharge line 48 between bypass line 78 and condenser 50. Valve 88 closes when valve 80 is opened, to assure flow of hot gas in series through coil 76 and condenser 50 when the heat reclaim coil is in use.

Valve 56 is adjusted to respond to a predetermined pressure so as to assure the desired condensing pressure in condenser 50 and produce at least partial flooding thereof under outdoor temperature conditions requiring throttling of the valve. This in turn maintains the head pressure of the compressors 40, 42, 44 at a desired operating level, sufficiently high to assure said partial flooding of the condenser at any ambient temperatures below the temperature valve to which the valve is pre-set.

The refrigerating system disclosed may utilize hot gas as a means for defrosting the evaporators. However, although a hot gas defrost means is illustrated, it is not critical to operation of the improvement comprising the present invention, and is illustrated purely as typical of one type of defrost which can be advantageously utilized with said improvement.

Thus, in the disclosed system, by way of example of a typical defrost means, hot gas from the compressors may be delivered through a hot gas header 46 and branch hot gas line 100 to any evaporators that require defrosting. Thus, when evaporator 62 is to be defrosted solenoid valve 102 in branch 103 of hot gas line 100 is opened to deliver hot refrigerant gas to the line 70, while valve 105 in return line 73 is closed. The hot gas then flows through evaporator 62 in a direction reverse to that in which the expanding gas flows during the refrigerating operation. As a result, the temperature of the coils and fins of the evaporator is elevated, to defrost the evaporator. In the process of defrosting the evaporator, the hot gas is cooled and is at least partially condensed to a liquid. The resulting condensate then flows through bypass line 106 and check valve 107 about the expansion valve 94, and returns through line 66 to the liquid line 54.

In order to assure proper operation of the expansion valves at times when several evaporators are being defrosted at the same time (a situation in which the demand for hot gas from the compressor is so great as to reduce the pressure thereof in line 100), a receiver pressure sensing line 110 is connected to receiver 58 and extends to a regulating valve 112 located in compressor discharge line 48 downstream from the juncture of lines 48 and 100. Valve 112 is normally open but operates to restrict the flow of gas from the compressor through discharge line 48 in the event that the pressure in the discharge line should fall below the desired liquid line pressure. In this event valve 112 tends to close and modulate to increase the compressor head pressure and the pressure applied to the liquid refrigerant within the receiver through pressure control line 98, which in the disclosed embodiment extends from the top of the receiver to a juncture with line 48 downstream from valve 112. An adequate and pre-determined difference in pressure between the hot gas used for defrost purposes and the liquid refrigerant supplied to the evaporators is thus assured under all operating conditions.

Depending upon the ambient temperature to which the condenser 50 is subjected, elements 116, 118 responsive to compressor suction pressures are provided to cycle off one, and sometimes two, of the several compressors.

When automatically high ambient temperature conditions are encountered, it may sometimes be necessary to resort to the use of an evaporative type sub-cooling device 120. This is only illustrated, however, because of its inclusion in the basic system disclosed in U.S. Pat. No. 3,905,202. It may be found unessential to successful operation of the system as improved by the present invention but is nevertheless disclosed as an optional device usable in the system.

All the above has been illustrated and described in U.S. Pat. No. 3,905,202 with the exception of the check valve 57, a check valve 122 in line 98 upstream from valve 96, and the extension of line 98 to discharge line 48. The check valves, and the extension of line 98 to a juncture with line 48 at the location disclosed, have been found desirable in a commercial embodiment but like the rest of the basic system do not comprise part of the present invention.

In accordance with the present invention, valve 96 is a differential pressure regulating valve, and utilizes a pressure sensing means preferably in the form of a capillary tube 124 extending into pressure-sensory relationship to liquid line 52, between valve 56 and the outlet of the condenser 50.

This concept becomes of importance in changing the operating characteristics of the entire system during the refrigeration cycle thereof.

In considering examples of the operation, it should first be noted that discharge line pressure in line 48 is normally higher, in a typical working system, than the pressure existing in line 52 between condenser 50 and valve 56 (the "condensing pressure"). The condensing pressure is always lower than the compressor discharge pressure, but stays at a value very close to that of the compressor discharge pressure, normally on the order of four or five p.s.i. lower.

As a result, if for example valve 56 is set at 175 p.s.i., it begins to close and modulate whenever the condensing pressure drops below that value. The condensing pressure would drop, it may be noted, responsive to a drop in the head pressure of the compressor means 40, 42, 44, because any drop in pressure in the compressor discharge line 48 (that is, any drop in head pressure) is reflected as a corresponding drop in the condensing pressure existing in line 52 between valve 56 and condenser 50. The differential, as previously noted, is a constant, that is, a pressure of 175 p.s.i. in line 48 means that there is a pressure in line 52 upstream from valve 56 of approximately 170 p.s.i.

If valve 56 is set, by way of example, at 175 p.s.i., then the appearance of 170 p.s.i. in line 52 at the inlet side of valve 56 causes the valve to tend to close and modulate, to elevate the pressure at its inlet to its setting of 175 p.s.i. This in turn would produce a corresponding increase in compressor discharge line 48, elevating the pressure there to 180 p.s.i. There is, thus, an established, automatically maintained pressure differential between the head pressure represented by the pressure in the compressor discharge line 48, and the condensing pressure represented by the pressure in line 52 between the inlet of valve 56 and the outlet of condenser 50.

In the prior art devices as disclosed in the abovementioned patents, the receiver pressure control valve (valve 96 of U.S. Pat. No. 3,905,202 and valve 46 of U.S. Pat. No. 4,012,921) had a fixed setting which might, for example, be 175 p.s.i. As a result, the receiver pressure control valves of the prior art systems disclosed in these patents opened, should the pressure within the receiver drop below the setting of the valve, so as to elevate the receiver pressure to the fixed setting. Said valves, however, remained closed no matter how high the pressure within the receiver should go above the fixed setting.

This produced certain undesirable results, in that there was no maintenance of a prescribed relationship between the receiver pressure on the one hand and the condensing and head pressures (or more specifically the differential therebetween) on the other hand.

The failure to establish and maintain such a relationship, in the prior art devices as represented by the above-mentioned patents, under certain circumstances resulted in, for example, filling of the receiver with liquid with resulting starving of the expansion valves. For instance, the receiver pressure control valve simply remained closed, and non-operating, whenever the receiver pressure should go above the fixed setting, for example, 175 p.s.i. Should the receiver pressure drop too far below the discharge or head pressure, during this mode then the relatively high pressure resulting in line 52 (4–5 p.s.i. less than the head pressure) in respect to the low pressure within the receiver would be translated into the filling of the receiver with liquid.

In accordance with the invention, receiver pressure is controlled in a wholly new manner, by means of a valve in a line extending from the receiver to the compressor discharge line, the valve being set to open and modulate to permit one-way flow from the compressor discharge line to the receiver, for the purpose of establishing and maintaining a receiver pressure which is at a prescribed value in respect to the pressure differential between the condensing and head pressures as established and maintained by operation of the valve 56. In a typical working embodiment, as noted above the condensing pressure is approximately four or five p.s.i. less than the head pressure. Therefore, whenever valve 56 operates to establish the condensing pressure at a desirable, predetermined operating level, this is translated automatically into a head pressure approximately four or five p.s.i. above that established in line 52 by modulation of valve 56. In turn, the receiver pressure is automatically adjusted to a value which is a function of this pressure differential. In a working embodiment, it is proposed, desirably, to establish the receiver pressure at a level approximately five to ten p.s.i. less than the condensing pressure in line 52.

In these circumstances, it has been found that the tendency toward "logging" of the receiver is eliminated, thus in turn eliminating resultant starving of the expansion valves.

Of great importance, further, is the fact that establishing and maintaining a receiver pressure so that it will closely follow the condensing pressure, increases the versatility of the refrigeration systems shown in U.S. Pat. Nos. 4,012,921 and 3,905,202. Heretofore, the range of settings that could be utilized in valve 56 was limited by the requirement for a fixed setting of the receiver pressure control valve 96 of U.S. Pat. No. 3,905,202 of 46 of U.S. Pat. No. 4,012,921. Settings for valve 56 would have to fall in a range the lower limit of which would be above the fixed setting of the receiver pressure control valve. That fixed setting could not be selected to fall below, for example, about 175 p.s.i. in actual practice. This, in turn, prevented the system from making maximum use of outdoor ambient air temperatures for energy saving purposes. The reason is that the receiver pressure must be lower than the head pressure, and by having an arrangement in which the receiver pressure in effect follows the condensing pressure, and is a function of the pressure differential between the condensing and head pressures, one can set valve 56 at any pressure desirable to make optimum use of the expected outside ambient temperatures. One might, for example, set valve 56 at 140 p.s.i. rather than at a normal 185 p.s.i. In accordance with the invention the receiver pressure would automatically be controlled as a function of the differential between the condensing and head pressures of 140 and 145 p.s.i. respectively that would be established as desirable operating levels under these particular circumstances. This would be desirable in high outside temperature conditions. The converse is true when the outside ambient air temperature is low. Under these latter conditions, it may be desired to establish, through appropriate setting of valve 56, a condensing pressure of 175 p.s.i., resulting in a head pressure of approximately 180 p.s.i. This, in accordance with the present invention, would automatically maintain the receiver pressure at about 165–170 p.s.i. In all settings of the valve 56, an optimum relationship is established and maintained between the receiver pressure, the condensing pressure, and the head pressure, such as to prevent binding of liquid within the receiver, filling of the receiver with liquid, and other undesirable operating characteristics.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. In a refrigeration system including a compressor, a condenser, a receiver, an evaporator, a discharge line extending from the compressor to the condenser, a liquid line extending from the condenser to the evaporator, a connecting line between the liquid line and the receiver, a return line extending from the evaporator to the compressor, an inlet pressure regulating valve in the liquid line adapted to establish and maintain pressures in the liquid and discharge lines at pre-selected, different operating levels, and a receiver pressure control line connected between the compressor discharge line and the receiver, the improvement comprising a differential pressure regulating valve that controls communication between the discharge line and the receiver through the receiver pressure control line, and that is sensitive to the pressure differential between the liquid and discharge lines to establish and maintain the receiver pressure at a valve which is a function of said pressure differential, said differential pressure regulating valve being mounted in the receiver pressure control line to control flow therethrough.

2. In a refrigeration system the improvement of claim 1 wherein the pressure maintained by the inlet pressure regulating valve in the liquid line is less than that in the discharge line.

3. In a refrigeration system the improvement of claim 2 wherein the differential between the liquid and discharge line pressures is on the order of about 10 p.s.i.

4. In a refrigeration system an improvement according to claims 1, 2 or 3 wherein the receiver pressure established and maintained by the differential pressure regulating valve closely follows but is less than the pressure maintained in the liquid line by the inlet pressure regulating valve.

5. In a refrigeration system an improvement according to claims 1, 2 or 3 wherein the receiver pressure maintained by the differential pressure regulating valve is on the order of approximately 1 to 10 p.s.i. less than the pressure maintained in the liquid line by the inlet pressure regulating valve.

6. In a refrigeration system including a compressor, a condenser, a receiver, an evaporator, a discharge line extending from the compressor to the condenser, a liquid line extending from the condenser to the evaporator, a connecting line between the liquid line and the receiver, a return line extending from the evaporator to the compressor, an inlet pressure regulating valve in the liquid line adapted to establish and maintain pressures in the liquid and discharge lines at pre-selected, different operating levels, and a receiver pressure control line connected between the compressor discharge line and the receiver, the improvement comprising a differential pressure regulating valve that controls communication between the discharge line and the receiver through the receiver pressure control line, and that is sensitive to the pressure differential between the liquid and discharge lines to establish and maintain the receiver pressure at a value which is a function of said pressure differential, said differential pressure regulating valve including pressure-sensing means extending from the differential pressure regulating valve to a sensing point located on the liquid line between the condenser and the inlet pressure regulating valve.

7. In a refrigeration system the improvement of claim 6 wherein the pressure-sensing means is a capillary tube.

8. In a refrigeration system including a compressor, a condenser, a receiver, an evaporator, a discharge line extending from the compressor to the condenser, a liquid line extending from the condenser to the evaporator, a connecting line between the liquid line and the receiver, a return line extending from the evaporator to the compressor, an inlet pressure regulating valve in the liquid line adapted to establish and maintain pressures in the liquid and discharge lines at pre-selected, different operating levels, and a receiver pressure control line connected between the compressor discharge line and the receiver, the improvement comprising a differential pressure regulating valve mounted in the receiver pressure control line to control the flow of fluid therethrough from the compressor discharge line to the receiver and including a sensing element extending into pressure-sensing relationship to the liquid line at a location between the first valve and the condenser, the first valve being adapted to establish and maintain a pressure differential between the discharge and liquid lines in which the discharge line pressure is in excess of that of the liquid line at the sensing location to the extent of approximately 10 p.s.i., and the second valve being responsive to the liquid line pressure at the sensing location to establish and maintain a pressure in the receiver closely approximating the pressure sensed in the liquid line.

* * * * *

UNITED STATES PATENT AND TRADEMARK OFFICE

CERTIFICATE OF CORRECTION

PATENT NO. : 4,231,229

DATED : November 4, 1980

INVENTOR(S) : Benjamin R. Willitts

It is certified that error appears in the above-identified patent and that said Letters Patent are hereby corrected as shown below:

Column 4, line 33, change "automatically" to --abnormally--.

Column 6, line 22, change "of" second occurrence to --or--.

Column 7, line 18, change "valve" to --value--.

Signed and Sealed this

Seventeenth Day of November 1981

[SEAL]

Attest:

GERALD J. MOSSINGHOFF

Attesting Officer

Commissioner of Patents and Trademarks